US005304087A

United States Patent [19]

Terzian et al.

[11] Patent Number: 5,304,087

[45] Date of Patent: Apr. 19, 1994

[54] SOFT STUFFED TOY WITH MANUALLY DRIVEN HEAD, EARS AND/OR TONGUE

[75] Inventors: Rouben T. Terzian; Shari L. Smith, both of Chicago, Ill.

[73] Assignee: Breslow, Morrison, Terzian & Associates, Inc., Chicago, Ill.

[21] Appl. No.: 832,739

[22] Filed: Feb. 7, 1992

[51] Int. Cl.[5] ..... A63H 3/20; A63H 3/36; A63H 3/02; A63H 3/46

[52] U.S. Cl. ..... 446/340; 446/337; 446/359; 446/372; 446/384

[58] Field of Search ..... 446/330, 337, 338, 339, 446/340, 352, 353, 359, 369, 370, 371, 372, 373, 374, 379, 384, 391

[56] References Cited

U.S. PATENT DOCUMENTS

| | | | |
|---|---|---|---|
| 3,014,309 | 12/1961 | Carroll | 446/338 X |
| 3,087,277 | 4/1963 | McCook | 446/27 |
| 3,475,853 | 11/1969 | Adler | 446/330 |
| 3,648,405 | 3/1972 | Tepper | 446/330 |
| 3,840,974 | 10/1974 | Georgen et al. | 446/338 X |
| 3,964,205 | 6/1976 | Kuramochi | 446/338 |
| 4,164,827 | 8/1979 | Palumbo | 446/340 X |
| 4,263,742 | 4/1981 | Terzian | 446/340 |
| 4,304,063 | 12/1981 | Katzman et al. | 446/183 |
| 4,345,400 | 8/1982 | Katzman et al. | 446/10 |
| 4,412,682 | 11/1983 | Rehkemper et al. | 273/447 |
| 4,516,951 | 5/1985 | Saigo et al. | 446/338 |
| 4,662,855 | 5/1987 | Morrison | 446/227 |
| 4,699,603 | 10/1987 | Saigo et al. | 446/353 X |
| 4,979,921 | 12/1990 | Cardillo | 446/28 X |

FOREIGN PATENT DOCUMENTS

| | | | |
|---|---|---|---|
| 263446 | 12/1926 | United Kingdom | 446/337 |
| 334373 | 9/1930 | United Kingdom | 446/352 |
| 664441 | 1/1952 | United Kingdom | 446/352 |
| 1540078 | 2/1979 | United Kingdom | 446/391 |
| 2068243 | 8/1981 | United Kingdom | 446/198 |

*Primary Examiner*—Robert A. Hafer
*Assistant Examiner*—D. Neal Muir
*Attorney, Agent, or Firm*—Dick and Harris

[57] ABSTRACT

A soft stuffed puppy is carried in a flexible sling with the head of the puppy exposed. The head has animatable ears driven by rotation of the head relative to the body. In addition, a protruding moveable tongue is driven by an actuator which also serves to effect the rotation of the head relative to the body. Actuation of the animatable ears and tongue may be readily accomplished while the puppy is carried in the sling by a child.

13 Claims, 2 Drawing Sheets

SOFT STUFFED TOY WITH MANUALLY DRIVEN HEAD, EARS AND/OR TONGUE

BACKGROUND OF THE INVENTION

1. Field of the Invention

This invention relates to animatable toy characters and particularly to soft stuffed toy characters with manually animatable features.

2. Background Art

Soft dolls, animals and characters are popular playthings, particularly for younger children. Basic play with such toys involves considerable carrying and cuddling of the toy by the child. In addition, animatable features of soft dolls, animals and characters enhance their play value. Thus, for example, Katzman et al. U.S. Pat. No. 4,304,063 issued Dec. 8, 1981 and Terzian U.S. Pat. No. 4,263,742 issued Apr. 28, 1981 disclose soft stuffed dolls having animated facial features, including a moveable tongue in the Katzman et al. doll, that respond to pressure upon the abdomen area of the doll. In Morrison U.S. Pat. No. 4,662,855 issued May 5, 1987, an animated, pop-up crib toy is driven upwardly to extend the flexible neck of the character by a motor and mechanism housed in a box mounted on the edge of a crib. Katzman et al. U.S. Pat. No. 4,345,400 issued Aug. 24, 1982 shows a plush piggy bank with facial features that are animated by a mechanism actuated by depositing a coin into the bank. In the action game of Rehkemper et al. U.S. Pat. No. 4,412,682 issued Nov. 1, 1983, enjoyment of the game is enhanced by insertion of manually manipulatable members in the flexible arms of a character so that the arms of the character are animated as the game is played. Nevertheless, there remains a need for soft dolls, animals or characters having features that may be manually animated by a child, particularly as the child holds or cuddles the character close to the child's body. There also remains a need for such a soft character in combination with a device to facilitate the child's carrying of the soft character while being able to manually animate features of the character.

SUMMARY OF THE INVENTION

The present invention is concerned with providing a soft stuffed toy character with manually animatable features that are activated by relative rotation of the head with respect to the body. In addition, a device for a child to carry the toy character in a position that facilitates manual actuation of the animatable features is provided.

BRIEF DESCRIPTION OF THE DRAWINGS

For a better understanding of the present invention, reference may be had to the accompanying drawings in which.

DETAILED DESCRIPTION

Figure 1:
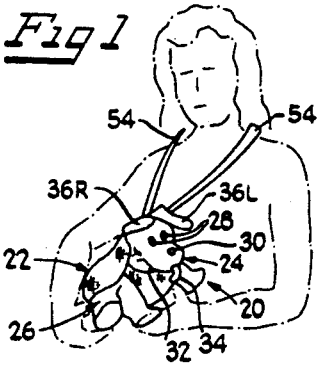
FIG. 1 is a perspective view of an embodiment of the present invention showing a soft stuffed puppy in a carrying sling worn by child.

Referring now to the drawings in which like parts are designated by like reference numerals throughout the several views, there is shown in FIG. a soft stuffed puppy 20 being carried by a child in a carrying sling 22. Puppy 20 has a head 24 and a body 26. Head 24 includes a pair of eyes 28, a nose 30, a mouth 32 with a moveable tongue 34 and moveable ears 36R and 36L.

Figure 2:
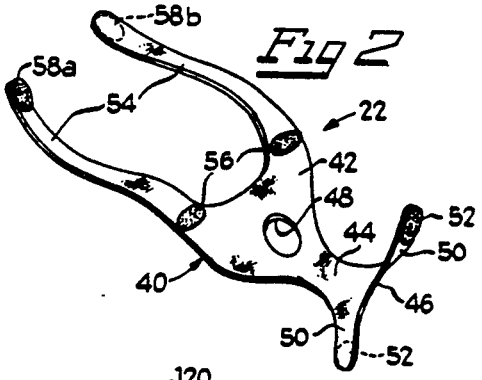
FIG. 2 is an enlarged scale, perspective development view of the carrying sling shown in FIG. 1.

Carrying sling 22 is shown in greater detail in FIG. 2 where it can readily be seen that the sling includes a main enclosure forming piece 40 comprising a back portion 42, an intermediate narrowed bottom portion 44 and a front or chest portion 46. Adjacent the transition area from back portion 42 to the intermediate narrowed portion 44 is a hole 48 to accommodate a tail apendage. Chest portion 46 has two outwardly extending opposed tabs 50. Adjacent the free end of each of tabs 50 is a patch 52 of either the hook material or the loop material of "VELCRO" hook and loop fastening material. Back portion 42, opposite the transition to the narrowed intermediate portion 44, bifurcates into two elongated straps 54. In approximately the area where back portion 42 bifurcates into the straps, there is a patch 56 of the cooperating hook material or loop material required for fastening engagement with a respective one of patches 52. Adjacent the free ends of each of straps 54 are mating patches **58*a* and 58*b*** of "VELCRO" hook and loop fastening material.

It will be appreciated from FIGS. 1 and 2 that a toy character such as toy stuffed puppy 20 may be placed upon open sling 22 with the tail (not shown) of the puppy extending through hole 48. Chest portion 46 is then brought between the legs of the puppy and fastening patch 52 on one side is secured to the corresponding mating fastening patch 56 on back portion 42. Patches 52 and 56 on the other side are then similarly fastened to secure the puppy within the sling. The free ends of straps 54 are secured together by fastening patches **58*a* and 58*b*** forming a closed loop facilitating the child's wearing of the sling. As an alternative, a sling may be formed with straps already secured together to form a loop and then the loop is passed over the head and/or arm of the child for wearing.

Figure 3:
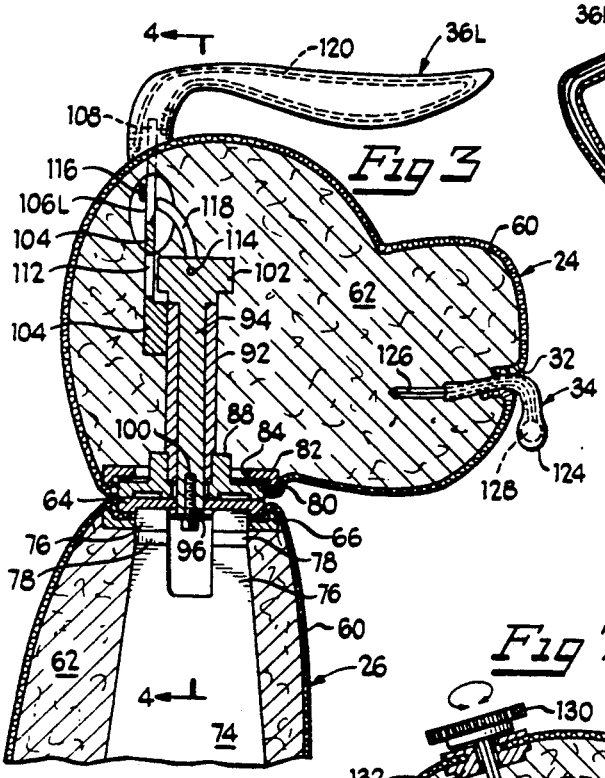
FIG. 3 is an enlarged scale, fragmentary, generally central vertical sectional view of the soft stuffed puppy shown in FIG. 1.
Figure 4:
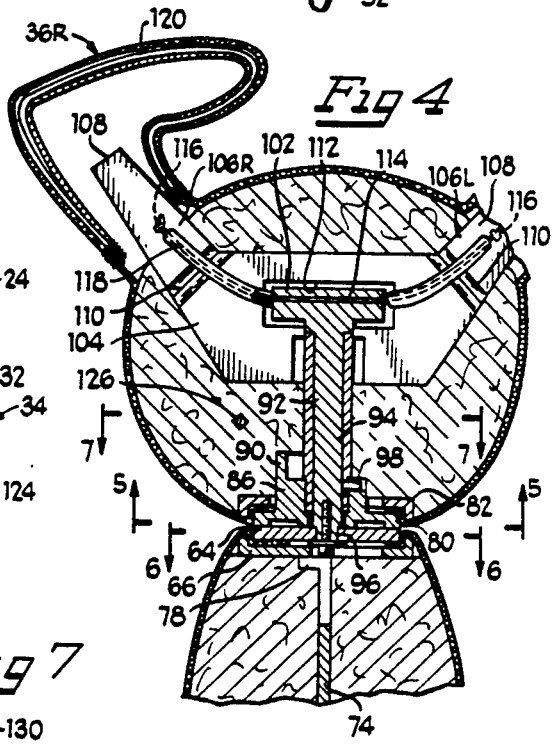
FIG. 4 is a fragmentary sectional view taken generally along line 4—4 of FIG. 3.
Figure 5:
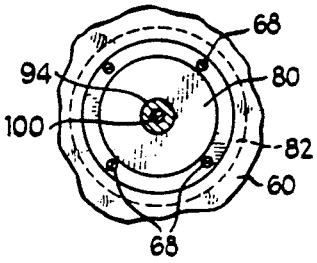
FIG. 5 is a sectional view taken generally along line 5—5 of FIG. 4.
Figure 7:
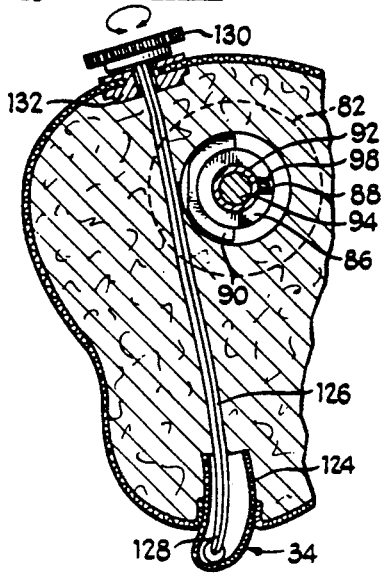
FIG. 7 is a sectional view taken generally along line 7—7 of FIG. 4.
Figure 6:
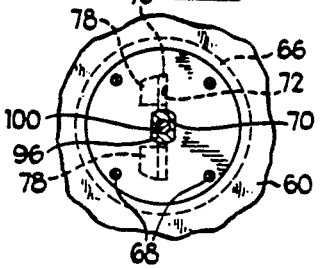
FIG. 6 is a sectional view taken generally along line 6—6 of FIG. 4.
Figure 8:
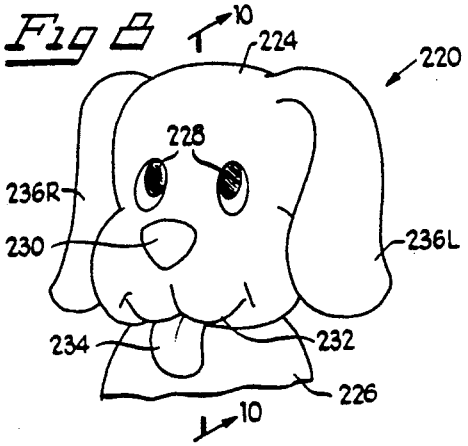
FIG. 8 is a perspective view of the head of a soft stuffed puppy of another embodiment of the present invention.
Figure 9:
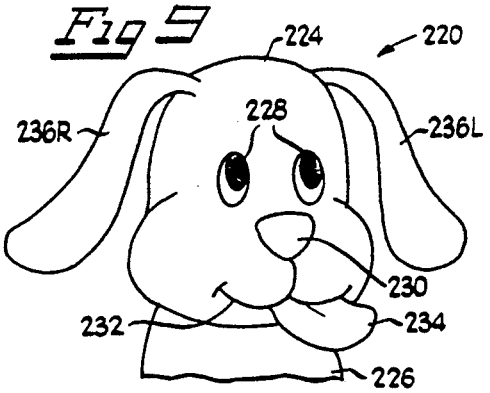
FIG. 9 is another perspective view of the same soft stuffed puppy as in FIG. 1 but showing the ears and tongue after they have been animated.

As illustrated in the sectional views of FIGS. 3, 4 and 7, both head 24 and body 26 of puppy 20 are separately formed of a suitable, preferably plush material 60. Each of head 24 and body 26 are stuffed with a conventional filler material 62. Secured adjacent the upper end of body 24 is a body neck collar 64 and its cooperating retaining flange 66. Part of fabric 60, or a piece of another fabric attached to fabric 60 by sewing, is sandwiched between collar 64 and flange 66, which are then held together by screws 68. Rivets, adhesives, ultrasonic welding or other conventional fastening means may be used in place of screws 68.

Collar 64 has generally centrally disposed keyed opening 70. Flange 66 includes a diametrical slot 72. Contained within body 26 is an elongated anchor or stabilizer 74. Adjacent its upper end, stabilizer 74 is bifurcated to form spaced apart fins 76. Spaced below the free ends of each of the fins is a ledge 78. Each of fins 76 fit into and are engaged within slot 72 with the upper side of each ledge 78 abutting the underside of flange 66. Stabilizer 74 thus helps prevent shearing or tearing of the securement of collar 64 and flange 66 from body 26 and material 60 forming the body.

Head 24 has a head neck collar 80 and a cooperating retaining flange 82 adjacent the lower, neck end of the head. Collar 80 and flange 82 cooperate to sandwich between them and secure either a portion of material 60 or some other material attached to material 60 by sewing. Similar to collar 64 and flange 66, collar 80 and flange 82 are secured together by four screws 68 or other suitable fasteners.

There is a generally centrally disposed opening 84 in collar 82 through which sleeve 86 extending upwardly from collar 80 into head 24 freely passes. In the top of collar 86 is a radial slot 88. Extending further upwardly into head 24 beyond the top of sleeve 86 is an approximately one hundred eighty degree arcuate segment 90. An elongated tubular sleeve 92 rotatably receives a shaft 94. The lower ends of shaft 94 and tubular sleeve 92 are mounted within sleeve 86. At its lower end 96, shaft 94 is keyed to fit keyed opening 70 in body collar 64.

Adjacent its lower end, tubular sleeve 92 has a radially extending pin 98 that is received in slot 88 of collar 86. Shaft 94 is secured against axial displacement with respect to body collar 64 by a threaded fastener 100. It will be appreciated that because of the keyed engagement between shaft 94 and body collar 64 that shaft 94 will rotate with collar 64. Because of the engagement of pin 98 in slot 88 of collar 86, tubular sleeve 92 will remain in rotational engagement with head collar 80, and accordingly head 24, as long as fastener 100 prevents any axial displacement of shaft 94 with respect to head collar 80. However, should fastener 100 loosen such that shaft 94 may be actually displaced upwardly a sufficient distance to disengage pin 98 from slot 88, complete rotation of head 24 with respect to body 26 will be prevented by the abutment of pin 98 with either side of arcuate segment 90.

Adjacent the top of shaft 94 is a transverse cross piece 102. At the top of tubular sleeve 92 is a plastic yoke 104, the bifurcated members 106R and 106L of which, or more particularly their free ends 108, extend out of head 24 into a respective one of ears 36R and 36L. Where each member 106R and 106L joins the main body of yoke 104 there is a reduced cross section 110 which forms a living hinge facilitating the forward flexing of each of members 106R and 106L, that is toward eyes 28 and nose 30. Generally centrally disposed in the body of yoke 102 is a generally rectangular opening 112 that accommodates rotational movement of cross piece 102. A flexible plastic filament, wire or cable 114 extends through transverse cross piece 102. Each end of cable 114 passes through an aperture in a respective one of members 106 and is secured against removal by a knot 116 formed in the end of the cable. Intermediate cross piece 102 and each member 106 is a flexible plastic tube 118 that fits over cable 114.

Secured around the internal periphery of each ear 36R and 36L is a soft wire stiffener 120 which facilitates individual positioning or posing of each of the ears. It will be appreciated that as head 24 is rotated with respect to body 26, shaft 94 will rotate and, depending upon the direction of rotation, initially pull, via cable 114, one of members 106R and 106L forwardly. As such rotation continues, the one member will continue to be pulled forwardly and then the other member will also start to be pulled forwardly, although not to the same extent. Thus, for example, if head 24 is rotated clockwise with respect to the body 26, member 106R and hence ear 36R will be pulled forwardly and then as such rotation continues, with the left side of cross piece 102 moving into aperture or opening 112, the other end of cable 114 will also be tightened and pull down member 106R forwardly and downwardly, although not as far as member 106R. Rotational return of head 24 to a centered position with respect to body 26 urges members 106R and 106L, together with their respective ears, back to a more upright position. Tubes 118 assist in transferring the rotational motion of cross piece 102 into rearward and upward movement of members 106R and 106L about their respective hinge sections 110.

Mouth 32 of head 24 is formed with a simulated protruding tongue 34 that is conveniently made of a different material 124 than the material 60 forming the head. Tongue 34 is formed as a hollow sleeve and has a relatively rigid elongated member 126 extending into it. Member 126 is preferably bent at approximately a right angle a short distance back from the end extending into tongue 34 to form an offset 128. At the opposite end, member 126 continues to extend all the way through head 24, as is best illustrated in FIG. 7, to the outside of the rear of head 24 where it is rotationally secured to an actuator knob 130 after passing through an apertured flanged retainer 132 secured to material 60. Elongated member 126 may be formed of a square or rectangular cross section or otherwise keyed into knob 130 for rotational engagement. Thus, as knob 130 is rotated about its axis, tongue 34 will pivot from one side of mouth 34 to the other in a licking motion.

Knob 130 also conveniently provides a handle for side to side movement of head 24 with respect to body 26. Thus, as toy puppy 20 is carried in sling 22 worn by a child, the child may conveniently grasp and operate knob 130 to both rotate head 24 from side to side causing ears 36R and 36L to bend or "flap" forwardly and then return rearwardly, while at the same time rotating knob 130 to effect a side to side licking motion of tongue 34.

With puppy 20 in sling 22 and straps 54 secured and worn by the child, head 24 is exposed so that the animation of the ears and tongue may be viewed and enjoyed. In addition, actuator knob, which is disposed above back portion 42 of the sling, is readily accessible to the child for operation.

Another embodiment of a toy stuffed puppy is shown in FIGS. 8-13. A puppy 220 has a head 224 that is rotationally mounted atop a body 226. Head 224 includes eyes 228, nose 230, mouth 232 with a protruding tongue 234 plus ears 236R and 236L. As with the previous embodiment, rotational, side to side movement of head 224 relative to body 226 effects bending or "flapping"

movement of ears 236R and 236L. Also similar to the proceeding embodiment, protruding tongue 234 is moveable in a side to side licking motion with respect to mouth 232 as is best illustrated by comparison of FIGS. 8 and 9.

Again as with the previous embodiment, each of head 224 and body 226 is formed of a material, preferably a plush material, 238 and the inside of each of the head and body are stuffed with a conventional filler material 240 used for stuffed toy animals and the like. At the top of body 224 are a pair of upper and lower body neck flanges 242 and 244 which are secured together by threaded screws 246 or other suitable fastening means such as rivets, adhesives, ultrasonic welding or the like. Each of body neck flanges 242 and 244 have a generally centrally disposed aperture 248 which align when the flanges are secured together to sandwich material 238 between them. Extending upwardly from upper body neck flange 242 is a pin 250.

At the bottom of head 24 are a pair of head neck flanges 252 and 254. As with body neck flanges 242 and 244, head neck flanges 252 and 254 are secured together by screws 246 or the like to sandwich between them material 238 forming the head. Each of head neck flanges 252 and 254 have a generally centrally disposed aperture 258 which align when the flanges are assembled. Lower head neck flange 252 includes an arcuate groove 260. When head 224 is mounted atop body 226 for relative rotation, pin 250 engages arcuate slot 260 to limit the degree of rotation.

Depending downwardly from within head 224 is a shaft 262 which is slotted and barbed at its lower end 264 for retained insertion within aligned apertures 248 of body neck flanges 242 and 244 and for rotational engagement with the flanges. Adjacent the upper end of shaft 262, within head 224, shaft 262 has a transverse bore 266. Between upper head neck flange 254 and the upper end of shaft 262 is a gear box 270 through which shaft 262 passes. A generally centrally disposed spur gear 272 within gear box 270 is keyed or otherwise secured in some conventional manner to shaft 262 for rotation with the shaft. Mounted within gear box 270 for direct rotational engagement with spur gear 272 is a drive gear 274R adjacent one lateral side of the gear box. Also mounted within gear box 270, adjacent the opposite lateral side of gear box 270 are another drive gear 274L and an intermediate gear 276. Spur gear 272 does not directly engage drive gear 274L but rather engages intermediate gear 276 which then engages drive gear 276 so that both gears 274 and 276 will rotate in opposite directions in response to rotation of spur gear 272.

Figure 10:
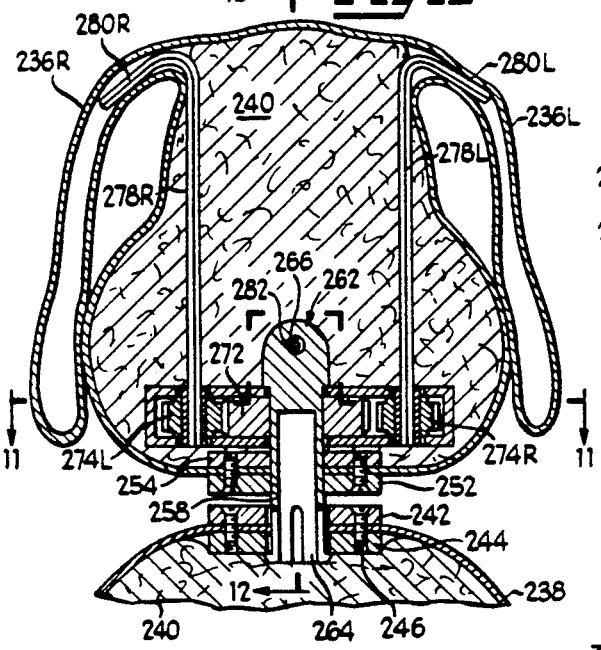
FIG. 10 is an enlarged scale, sectional view taken generally along line 10—10 of FIG. 8.
Figure 11:
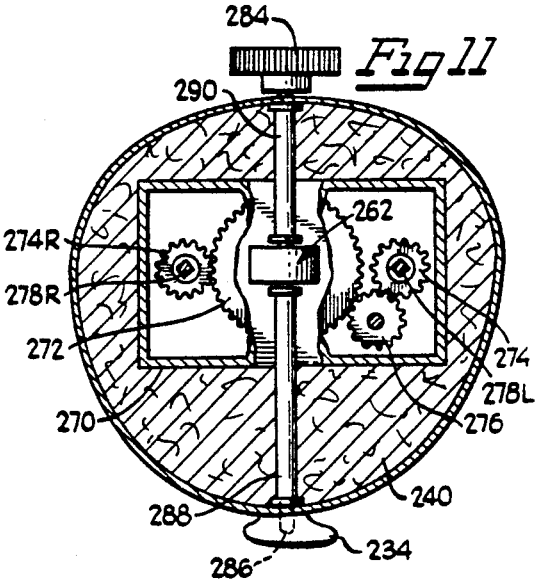
FIG. 11 is a sectional view taken generally along line 11—11 of FIG. 10.
Figure 12:
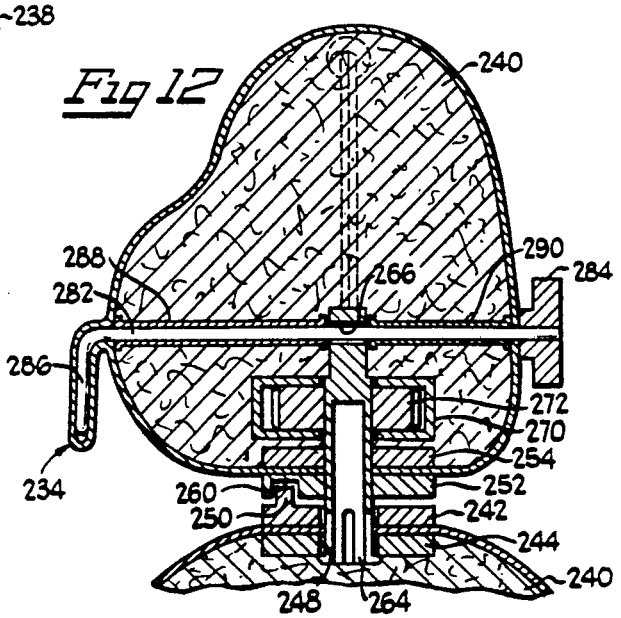
FIG. 12 is a sectional view taken generally along line 12—12 of FIG. 10.
Figure 13:
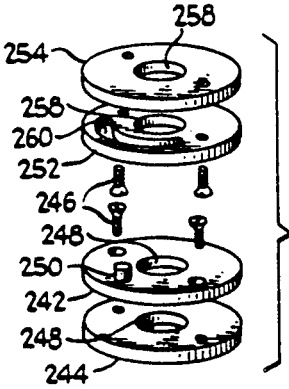
FIG. 13 is an exploded perspective view of part of the mechanism for the animatable features.

Extending upwardly from each of drive gears 274R and 274L, and in rotational engagement with the respective drive gear, is a generally vertically upstanding elongated member 278R and 278L. At the end distal from engagement with the respective drive gear, each elongated member 278R and 278L is bent with respect to its elongated direction to form a respective offset 280R and 280L. As is best illustrated in FIG. 10, offset 280R extends into hollow ear 236R and offset 280L extends into hollow ear 236L. When head 224 is rotated relative to body 226, shaft 262 will be rotated causing rotation of spur gear 272 which will drive, including through intermediate gear 276, each of drive gears 274R and 274L in opposite directions. In turn, each of elongated members 278R and 278L will be rotated and together with their respective offsets 280R and 280L will cause each of ears 236R and 236L to rotate toward and away from each other.

Extending from the back of head 224 through bore 266 and out the front of head 224 is a rotatable shaft 282. Adjacent its rearward end, shaft 282 is inserted into and rotationally engages a knob 284. As it extends forwardly of head 224 through mouth 232, shaft 282 is formed with a generally right angle offset 286 that fits into tongue 234. There is a tubular sleeve 288 around shaft 282 between mouth 232 and shaft 262 and a similar tubular sleeve 290 surrounds the portion of shaft 282 extending between shaft 262 and the back of head 224. As with the previous embodiment, rotation of knob 284 about its axis will cause a side to side licking type motion of tongue 234.

Knob 284 also provides a convenient handle facilitating rotational side to side movement of head 224 with respect to body 226 to effect the rotation or flapping of ears 236R and 236L. Although not expressly shown with respect to this embodiment, it also may be used in combination with a carrying sling such as sling 22 shown in FIGS. 1 and 2.

While particular embodiments of the present invention have been shown and described, it will be apparent that changes and modifications will occur to those skilled in the art. It is intended in the appended claims to cover all such changes and modifications as fall within the true spirit and scope of the present invention.

What is claimed as new and desired to be secured by Letters Patent is:

1. A soft stuffed toy comprising in combination:
a body;
a head mounted atop the body for relative rotational movement;
means anchored in the body and extending into the head for connecting the head to the body;
flexible ears mounted on the head for relative movement with respect to the head;
a pair of members carried within the head with a respective one of the members extending into each of the ears; and
the means anchored in the body effecting driven movement of the members and ears in response to rotational movement of the head relative to the body.

2. The soft stuffed toy of claim 1 in which the ears are driven for movement in the same general direction.

3. The soft stuffed toy of claim 1 in which the ears are driven for movement toward and away from each other.

4. The soft stuffed toy in claim 1 including:
a tongue carried protruding from the head for relative movement with respect to the head; and
means carried by the head for driving movement of the tongue relative to the head in response to manual manipulation of an actuator spaced away from the tongue.

5. The soft stuffed toy of claim 4 in which:
the head has a front and a back;
the tongue is carried adjacent the front; and
the actuator is carried adjacent the back.

6. The soft stuffed toy of claim 4 in which the actuator also cooperates to effect the relative rotational movement of the head relative to the body.

7. The soft stuffed toy of claim 6 further comprising in combination means for carrying the soft stuffed toy with the body substantially enclosed and the head exposed and the actuator operationally accessible.

8. The soft stuffed toy of claim 1 further comprising in combination means for carrying the soft stuffed toy with the body substantially enclosed and the head exposed.

9. The soft stuffed toy of claim 8 in which:

the means for carrying is formed of a flexible material; and means for fastening one portion of the flexible material to another to form an enclosure for the body.

10. The soft stuffed toy of claim 8 in which:

the means for carrying is formed of a flexible material;

the material includes portions for forming a strap to be worn by a child; and means for fastening the portions together to form the strap.

11. A soft stuffed toy comprising in combination:

a body;

a head mounted atop the body for relative rotational movement;

flexible ears mounted on the head for relative movement with respect to the head;

each of the ears including an elongated member;

a housing within the soft toy;

a pair of spaced apart gears in the housing;

each of the elongated members rotationally driven by being in fixed engagement with a respective one of the spaced apart gears;

an intermediate gear in the housing positioned between and in rotational engagement with both of the spaced apart gears; and both spaced apart gears and the intermediate gear being mounted within the housing for rotation about generally parallel axes wherein rotation of the head relative to the body effects rotation of said spaced apart gears.

12. The soft stuffed toy of claim 11 further comprising:

a tongue carried protruding from the head for relative movement with respect to the head;

a shaft carried by the head for rotation about an axis transverse to the axes of the gears for driving movement of the tongue relative to the head in response to manual manipulation of a part of the shaft spaced away from the tongue; and means extending into the head from the housing for supporting the shaft for rotation.

13. The soft toy of claim 12 in which the shaft also cooperates to effect the relative rotational movement of the head relative to the body.

* * * * *